US008760348B2

(12) United States Patent
Huang et al.

(10) Patent No.: US 8,760,348 B2
(45) Date of Patent: Jun. 24, 2014

(54) MULTI-BAND ANTENNA

(75) Inventors: Yi-Feng Huang, New Taipei (TW); Jia-Hung Su, New Taipei (TW); Kai Shih, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 213 days.

(21) Appl. No.: 13/489,448

(22) Filed: Jun. 5, 2012

(65) Prior Publication Data

US 2013/0321213 A1 Dec. 5, 2013

(51) Int. Cl.
*H01Q 1/38* (2006.01)

(52) U.S. Cl.
USPC ..... 343/700 MS; 343/702

(58) Field of Classification Search
CPC ..... H01Q 1/243; H01Q 9/42; H01Q 5/0051
USPC ..... 343/700 MS, 702, 848
See application file for complete search history.

(56) References Cited

U.S. PATENT DOCUMENTS 6,819,287 B2 * 11/2004 Sullivan et al. ..... 343/700 MS
7,924,230 B2 * 4/2011 Hung et al. ..... 343/702
7,932,861 B2 * 4/2011 Hung et al. ..... 343/700 MS
8,451,177 B2 * 5/2013 Shau et al. ..... 343/700 MS

* cited by examiner

*Primary Examiner* — Tan Ho
(74) *Attorney, Agent, or Firm* — Cheng-Ju Chiang

(57) ABSTRACT

A multi-band antenna includes a base plate of which a feeding portion, a connection section and a ground portion are connected with rear, front and left edges of the base plate respectively, a first radiating element connected with a right edge of the base plate and coplanar with the base plate, a second radiating element coplanar with the base plate and the connection section and connected with an upper portion of a left rim of the connection section with a free end thereof adjacent to the ground portion, and a third radiating element connected with a lower end of the left rim of the connection section. Wherein the second radiating element is apart located between the ground portion and the third radiating element.

6 Claims, 1 Drawing Sheet

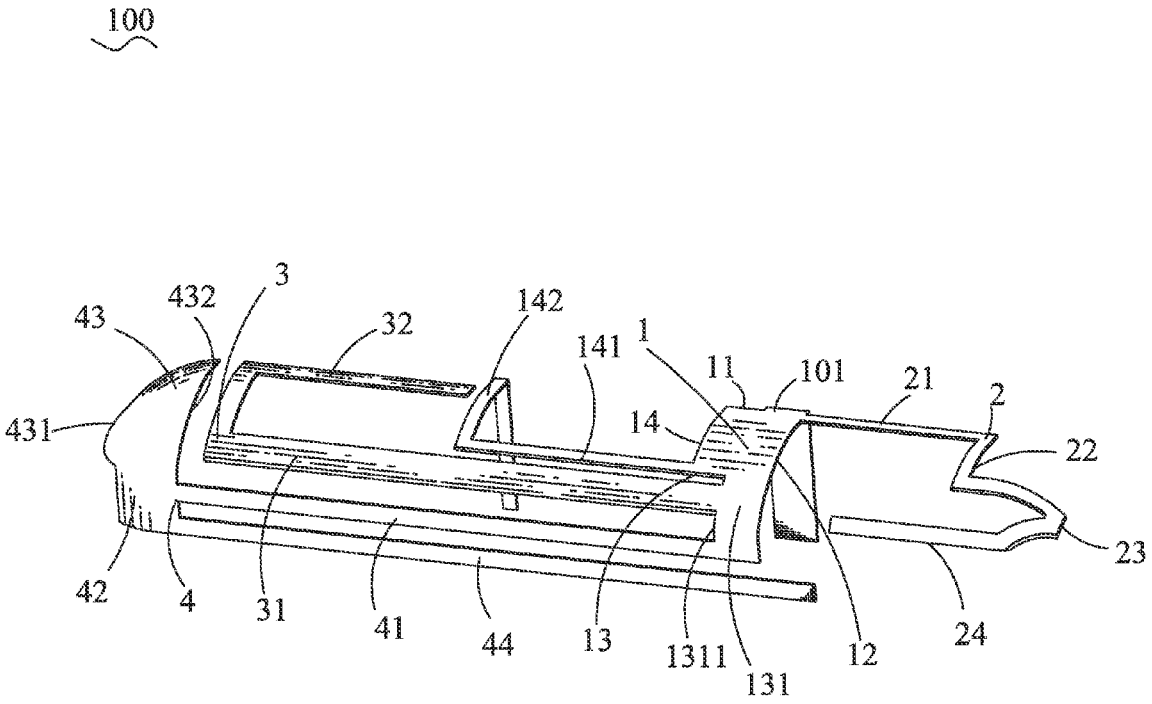
100
3
432
43
32
142
141
1
11
101
21
2
431
14
22
23
42
4
31
41
44
13
1311
131
12
24

MULTI-BAND ANTENNA

BACKGROUND OF THE INVENTION

1. Field of the Invention

The present invention relates to a multi-band antenna, and more particularly to a built-in multi-band antenna capable of being assembled to a portable wireless communicating device conveniently.

2. The Related Art

With the development of wireless communication technology, more and more portable wireless communicating devices, such as mobile phones and notebooks, are installed antenna systems for working in wireless wide area network (WWAN) systems. It's a trend for the wireless communicating device to have multiple wireless wide area network systems therein so as to make the mobile phones keep a good communicating performance anywhere. However, many different types of antennas for the portable wireless communicating devices are used, occupied space of the used antennas is larger, and manufacturing cost is higher. Furthermore, all of these antennas could not meet the demand of operating at multiple frequencies while the sizes thereof are reduced.

SUMMARY OF THE INVENTION

Accordingly, an object of the present invention is to provide a multi-band antenna. The multi-band antenna includes a base plate, a first radiating element, a second radiating element and a third radiating element. The base plate defines a rear edge, a front edge opposite to the rear edge, a right edge and a left edge opposite to the right edge. The right edge and the left edge are perpendicular to and connected with the rear edge and the front edge. A portion of the rear edge extends backward and then bends downward to form a feeding portion. An end of the front edge adjacent to the right edge extends frontward and inclines downward to form a connection section. A front end of the left edge extends leftward and then bends rearward to form a first connection strip coplanar with the base plate. An inverted-L shaped ground portion extends rearward and then bends downward from a rear end of the first connection strip. A first radiating element coplanar with the base plate includes a first radiating strip extended rightward from a rear end of the right edge of the base plate. A second connection strip is extended perpendicularly forward from a distal end of the first radiating strip. A curved second radiating strip is extended rightward and away from the second connection strip from a distal end of the second connection strip, and a third radiating strip is extended leftward and towards the connection section from a distal end of the second radiating strip. A second radiating element coplanar with the base plate and the connection section includes an extension section of substantially lying-L shape extended leftward and then bent rearward from a portion of a left rim of the connection section adjacent to the front edge of the base plate, and a first extension strip extended rightward and towards a level arm of the ground portion with a free end thereof adjacent to the level arm of the ground portion. A third radiating element includes a second extension strip extended leftward from a lower end of the left rim of the connection section. A third extension strip is apart and parallelly located under the second extension strip. An extension plate is connected with left ends of the second extension strip and the third extension strip and coplanar with the second extension strip and the third extension strip. Wherein the extension section of the second radiating element is apart located between the first connection strip and the second extension strip of the third radiating element.

As described above, the arrangement of the first radiating element, the second radiating element and the third radiating element makes the multi-band antenna transmit and receive multiple bands. In detail, the first radiating element resonates at a high frequency range covering 1710 MHZ to 2170 MHZ, the second radiating element resonates at a middle frequency range covering 1400 MHZ to 1500 MHZ, and the third radiating element resonates at a low frequency range covering 815 MHZ to 960 MHZ. Furthermore, the multi-band antenna is of a bending and miniaturized structure for conveniently being assembled in a portable wireless communication device, which makes the multi-band antenna occupy smaller space when assembled in the portable wireless communication device, and the manufacturing cost lower.

BRIEF DESCRIPTION OF THE DRAWINGS

The present invention will be apparent to those skilled in the art by reading the following description thereof, with reference to the attached drawings, in which:

The FIGURE is a perspective view of a multi-band antenna in accordance with the present invention.

DETAILED DESCRIPTION OF THE EMBODIMENT

Referring to the FIGURE, a multi-band antenna 100 made by LDS (Laser Direct Structuring) includes a base plate 1, a first radiating element 2, a second radiating element 3 and a third radiating element 4.

Referring to the FIGURE, the base plate 1 defines a rear edge 11, a front edge 13 opposite to the rear edge 11, a right edge 12 and a left edge 14 opposite to the right edge 13. The right edge 12 and the left edge 14 are perpendicular to and connected with the rear edge 11 and the front edge 13. A portion of the rear edge 11 extends backward and then bends downward to form a feeding portion 101. An end of the front edge 13 adjacent to the right edge 12 extends frontward and inclines downward to form a connection section 131. A front end of the left edge 14 extends leftward and then bends rearward to form a first connection strip 141 coplanar with the base plate 1. An inverted-L shaped ground portion 142 extends rearward and then bends downward from a rear end of the first connection strip 141. Vertical arms of the feeding portion 101 and the ground portion 142 are apart and parallelly coplanar with each other to together form an inductance in parallel.

Referring to the FIGURE, the first radiating element 2 coplanar with the base plate 1 includes a first radiating strip 21. The first radiating strip 21 is extended rightward from a rear end of the right edge 12 of the base plate 1. A second connection strip 22 is extended perpendicularly forward from a distal end of the first radiating strip 21. A curved second radiating strip 23 is extended rightward and away from the second connection strip 22 from a distal end of the second connection strip 22. The second radiating strip 23 is of substantial V shape with the mouth thereof facing the right edge 12 of the base plate 1. A third radiating strip 24 is extended leftward and towards the connection section 131 from a distal end of the second radiating strip 23.

Referring to the FIGURE, the second radiating element 3 is coplanar with the base plate 1 and the connection section 131 and includes an extension section 31 of substantially lying-L shape. The extension section 31 is extended leftward and then bent rearward from a portion of a left rim of the connection section 131 adjacent to the front edge 13 of the base plate 1. A first extension strip 32 extends rightward and towards a level arm of the ground portion 142 with a free end thereof adjacent to the level arm of the ground portion 142.

Referring to the FIGURE, the third radiating element 4 includes a second extension strip 41 extended leftward from a lower end of the left rim of the connection section 131. A third extension strip 44 is apart and parallelly located under the second extension strip 41. An extension plate 42 is connected with left ends of the second extension strip 41 and the third extension strip 44 and coplanar with the second extension strip 41 and the third extension strip 44. The extension section 31 of the second radiating element 3 is apart located between the first connection strip 141 and the second extension strip 41 of the third radiating element 4. The third extension strip 44 has a right end thereof further extended rightward beyond the connection section 131. The extension plate 42 is rectangular, and the third radiating element 4 further includes an extension slice 43. The extension slice 43 extends upward from an upper end of the extension plate 42 and is curved rearward in the process of extending upward to be coplanar with the second radiating element 3. The extension slice 43 is apart located in the left of the second radiating element 3, and has an arc edge 431 opposite to the second radiating element 3 and a straight edge 432 near to the second radiating element 3.

As described above, the arrangement of the first radiating element 2, the second radiating element 3 and the third radiating element 4 makes the multi-band antenna 100 transmit and receive multiple bands. In detail, the first radiating element 2 resonates at a high frequency range covering 1710 MHZ to 2170 MHZ, the second radiating element 3 resonates at a middle frequency range covering 1400 MHZ to 1500 MHZ, and the third radiating element 4 resonates at a low frequency range covering 815 MHZ to 960 MHZ. Furthermore, the multi-band antenna 100 is of a bending and miniaturized structure for conveniently being assembled in a portable wireless communication device, which makes the multi-band antenna 100 occupy smaller space when assembled in the portable wireless communication device, and the manufacturing cost lower.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A multi-band antenna, comprising:

a base plate defining a rear edge, a front edge opposite to the rear edge, a right edge and a left edge opposite to the right edge, the right edge and the left edge being perpendicular to and connected with the rear edge and the front edge, a portion of the rear edge extending backward and then bending downward to form a feeding portion, an end of the front edge adjacent to the right edge extending frontward and inclining downward to form a connection section, a front end of the left edge extending leftward and then bending rearward to form a first connection strip coplanar with the base plate, an inverted-L shaped ground portion extending rearward and then bending downward from a rear end of the first connection strip;

a first radiating element coplanar with the base plate including a first radiating strip extended rightward from a rear end of the right edge of the base plate, a second connection strip extended perpendicularly forward from a distal end of the first radiating strip, a curved second radiating strip extended rightward and away from the second connection strip from a distal end of the second connection strip, and a third radiating strip extended leftward and towards the connection section from a distal end of the second radiating strip;

a second radiating element coplanar with the base plate and the connection section including an extension section of substantially lying-L shape extended leftward and then bent rearward from a portion of a left rim of the connection section adjacent to the front edge of the base plate, and a first extension strip extended rightward and towards a level arm of the ground portion with a free end thereof adjacent to the level arm of the ground portion; and a third radiating element including a second extension strip extended leftward from a lower end of the left rim of the connection section, a third extension strip apart and parallelly located under the second extension strip, and an extension plate connected with left ends of the second extension strip and the third extension strip and coplanar with the second extension strip and the third extension strip, wherein the extension section of the second radiating element is apart located between the first connection strip and the second extension strip of the third radiating element.

2. The multi-band antenna as claimed in claim 1, wherein vertical arms of the feeding portion and the ground portion are apart and parallelly coplanar with each other to together form an inductance in parallel.

3. The multi-band antenna as claimed in claim 1, wherein the second radiating strip is of substantial V shape with the mouth thereof facing the right edge of the base plate.

4. The multi-band antenna as claimed in claim 1, wherein the third extension strip has a right end thereof further extended rightward beyond the connection section.

5. The multi-band antenna as claimed in claim 1, wherein the extension plate is rectangular, and the third radiating element further includes an extension slice extended upward from an upper end of the extension plate and curved rearward in the process of extending upward to be coplanar with the second radiating element, the extension slice is apart located in the left of the second radiating element, and has an arc edge opposite to the second radiating element and a straight edge near to the second radiating element.

6. The multi-band antenna as claimed in claim 1, wherein the first radiating element resonates at a high frequency range covering 1710 MHZ to 2170 MHZ, the second radiating element resonates at a middle frequency range covering 1400 MHZ to 1500 MHZ, the third radiating element resonates at a low frequency range covering 815 MHZ to 960 MHZ.

* * * * *